US012351221B2

(12) United States Patent
Busznyak

(10) Patent No.: US 12,351,221 B2
(45) Date of Patent: Jul. 8, 2025

(54) METHOD FOR IDENTIFICATION OF CAR ORDER ON A TRAIN AND CONTROL DEVICE FOR A RAILCAR

(71) Applicant: KNORR-BREMSE SYSTEME FÜR SCHIENENFAHRZEUGE GMBH, Munich (DE)

(72) Inventor: Imre Busznyak, Budapest (HU)

(73) Assignee: KNORR-BREMSE SYSTEME FÜR SCHIENENFAHRZEUGE GMBH (DE)

( * ) Notice: Subject to any disclaimer, the term of this patent is extended or adjusted under 35 U.S.C. 154(b) by 175 days.

(21) Appl. No.: 18/266,182

(22) PCT Filed: Nov. 19, 2021

(86) PCT No.: PCT/EP2021/082289
§ 371 (c)(1),
(2) Date: Jun. 8, 2023

(87) PCT Pub. No.: WO2022/122346
PCT Pub. Date: Jun. 16, 2022

(65) Prior Publication Data

US 2024/0034373 A1 Feb. 1, 2024

(30) Foreign Application Priority Data

Dec. 8, 2020 (EP) ..... 20212571

(51) Int. Cl.
*B61L 25/02* (2006.01)
*B61L 15/00* (2006.01)

(52) U.S. Cl.
CPC ..... *B61L 25/028* (2013.01); *B61L 15/0036* (2013.01)

(58) Field of Classification Search
CPC ..... B61L 25/028; B61L 15/0036
USPC ..... 701/19, 20
See application file for complete search history.

(56) References Cited

U.S. PATENT DOCUMENTS 5,651,517 A 7/1997 Stevens et al.

FOREIGN PATENT DOCUMENTS

CA 3047274 * 5/2020 ..... B61L 23/34
EP 0968897 A2 1/2000

OTHER PUBLICATIONS

International Search Report and Written Opinion corresponding to date PCT/EP2021/082289 Mar. 8, 2022.

* cited by examiner

*Primary Examiner* — Hai H Huynh
(74) *Attorney, Agent, or Firm* — Barnes & Thornburg LLP

(57) ABSTRACT

A method and equipment for determining a sequence of railcars connected to a locomotive on a train, wherein a control device of the locomotive is connected to railcars including a control device via a brake pipe, wherein the control device of the locomotive and the control devices of the railcars may exchange messages via a fast wireless network, wherein the method and equipment transmit a unique identification code via a slow network constituted by the brake pipe, transmit over a fast network messages indicative of a current state of the transmission carried out via the slow network, determining a time delay between the received state of transmission and a measured state of transmission and generating and sending associated report data.

14 Claims, 1 Drawing Sheet

METHOD FOR IDENTIFICATION OF CAR ORDER ON A TRAIN AND CONTROL DEVICE FOR A RAILCAR

CROSS REFERENCE AND PRIORITY CLAIM

This patent application is a U.S. National Phase of International Patent Application No. PCT/EP2021/082289 filed Nov. 19, 2021, which claims priority to European Patent Application No. 20212571.2, the disclosure of which being incorporated herein by reference in their entireties.

FIELD

Disclosed embodiments relate to a method for determining a sequence of railcars connected to a locomotive on a train, wherein a control device of the locomotive is connected to railcars comprising a control device via a brake pipe and wherein the control device of the locomotive and the control devices of the railcars may exchange messages via a fast network. Furthermore, the invention relates to a control device for a railcar.

BACKGROUND

Such a method is known from US 2002/0139181 A1, in which a brake test is carried out to determine a continuity test of a pneumatic brake pipe.

Furthermore, such a method is known from DE 20 2012 012 558 U1, in which a time between a pressure change effected at a locomotive and the arrival of its effect at a railcar is measured to determine the car order on the train.

In EP 3 081 445 A1, determination of the car order on the train is triggered by a predetermined sequence of pressure variations which are only registered when the railcar is standing still. When the determination of the car order is triggered, GPS positioning is used to determine the order of the railcars.

SUMMARY

A method and equipment are provided for determining a sequence of railcars connected to a locomotive on a train is proposed, wherein a control device of the locomotive is connected to railcars comprising a control device via a brake pipe, wherein the control device of the locomotive and the control devices of the railcars may exchange messages via a fast wireless network, and wherein the method comprises transmitting, by the control device of the locomotive of a unique identification code to the control devices via a slow network constituted by the brake pipe; transmitting, by the control device of the locomotive over the fast network, of messages indicative of a current state of the transmission carried out via the slow network, wherein the messages comprise the unique identification code; determining, by the control devices, of a time delay between the state of the transmission received from the control device and a state of the transmission measured on the slow network; calculating a distance of each railcar to the locomotive from the time delay and a propagation velocity of the slow network; requesting, by the control device of the locomotive of a report relating to the calculated distance and/or measured time delay by each railcar; sending, by the control device, a report in response to the above request, if an identification code in the request matches an identification code received via the slow network and ordering the railcars by their distance to the locomotive.

Railcars will thus only respond to locomotives that have the same unique identification code as the one received over the brake pipe. In this way, even when two or more trains stand side-by-side, each locomotive will only receive distance reports from railcars that are actually connected to it. Furthermore, this approach even works when some of the railcars are not equipped with control devices.

BRIEF DESCRIPTION OF FIGURES

These and other features of the disclosed embodiments will become apparent from the following detailed description of the invention when considered in conjunction with the accompanying drawings.

The drawings schematically represent.

DETAILED DESCRIPTION

Figure 1:
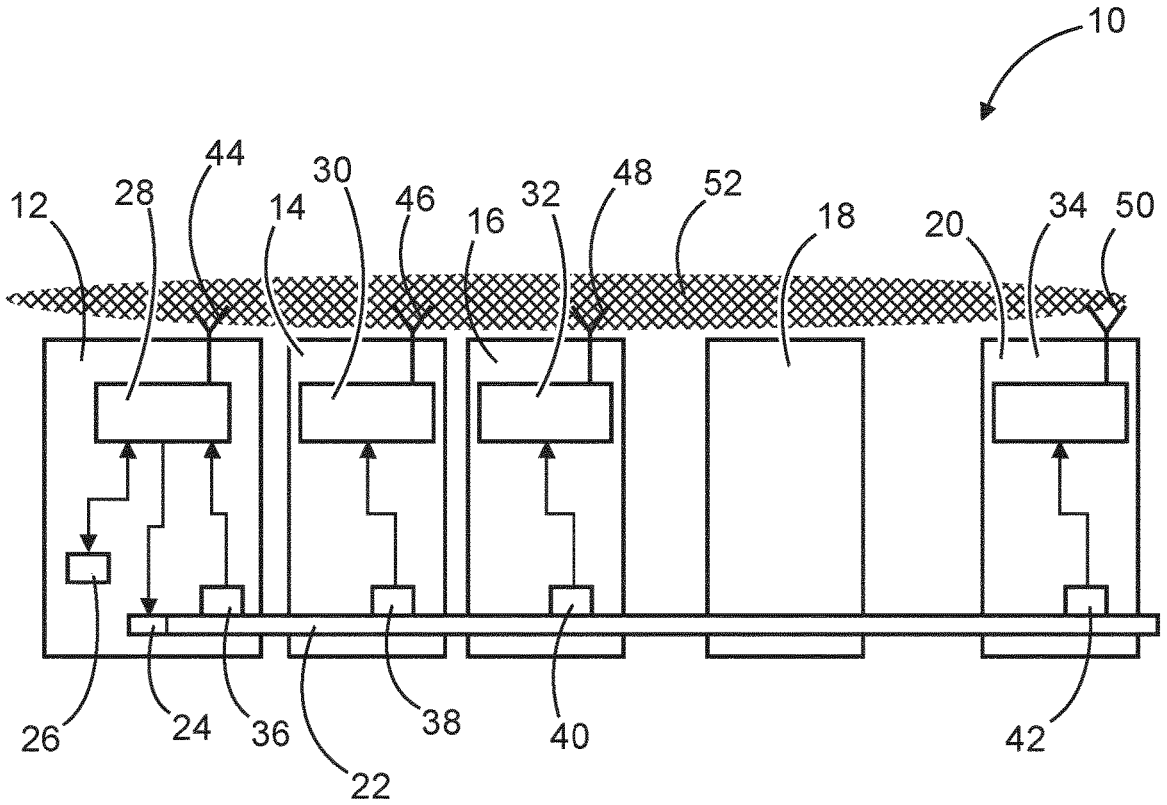
FIG. 1 a diagram of a train configuration for implementing a method according to an embodiment of the invention and FIG. 2 a diagram representing a pressure variation signal according to an embodiment of the invention.

When multiple trains standing close proximity, some of the above-mentioned methods may be triggered on multiple trains at the same time which would lead to multiple railcars responding to the brake test signals from locomotives that they are not connected to, e.g., when two trains stand side-by-side and both locomotives initiate the method for identification of car order, it is not possible to determine which railcars respond to which locomotive.

Other methods require an electrical communication connection between the railcars which may not be feasible when some of the railcars are equipped with such devices while others are not.

To solve the above-mentioned problem, a method for determining a sequence of railcars connected to a locomotive on a train is proposed, wherein a control device of the locomotive is connected to railcars comprising a control device via a brake pipe, wherein the control device of the locomotive and the control devices of the railcars may exchange messages via a fast wireless network, and wherein the method comprises transmitting, by the control device of the locomotive of a unique identification code to the control devices via a slow network constituted by the brake pipe; transmitting, by the control device of the locomotive over the fast network, of messages indicative of a current state of the transmission carried out via the slow network, wherein the messages comprise the unique identification code; determining, by the control devices, of a time delay between the state of the transmission received from the control device and a state of the transmission measured on the slow network; calculating a distance of each railcar to the locomotive from the time delay and a propagation velocity of the slow network; requesting, by the control device of the locomotive of a report relating to the calculated distance and/or measured time delay by each railcar; sending, by the control device, a report in response to the above request, if an identification code in the request matches an identification code received via the slow network and ordering the railcars by their distance to the locomotive.

Railcars will thus only respond to locomotives that have the same unique identification code as the one received over the brake pipe. In this way, even when two or more trains stand side-by-side, each locomotive will only receive distance reports from railcars that are actually connected to it.

Furthermore, this method even works when some of the railcars are not equipped with control devices.

In a further embodiment, the transmitting step by the control device of the locomotive comprises creating pressure variances in a brake pipe to encode the identification code for transmission, wherein the state of the transmission is the pressure generated in the brake pipe at the locomotive by a brake control unit.

This is one of the easiest ways to encode the identification code. It may be carried out at low cost in equipment.

In a further embodiment, determining the time delay between the state of the transmission received from the control device and the state of the transmission measured on the slow network may comprise measuring, by a pressure sensor associated with the control device, of a pressure in the brake pipe at the railcar; obtaining a first time derivative of the measured pressure in the brake pipe at the railcar; obtaining a second time derivative of the measured pressure in the brake pipe at the locomotive and determining the time delay as a time delay between corresponding sign changes of the first time derivative and the second time derivative.

In this way, absolute pressure within the brake pipe is not so relevant. In particular on long trains, the pressure arriving at the last railcar may be much lower than the pressure at the locomotive. By measuring only the change in pressure and looking for changes in the time derivative of the pressure, the communication of the identification code becomes more resilient.

In a further embodiment, the step of transmitting of messages indicative of the current state of the transmission by the control device of the locomotive may comprise measuring, by a pressure sensor associated with the control device of the locomotive, a pressure in the brake pipe at the locomotive; calculating the second time derivative from the pressure measured in the previous step; sending the second time derivative to the control devices the second time derivative values over the fast network as messages indicative of a current state of the transmission carried out via the slow network and wherein the obtaining a second time derivative includes receiving the messages comprising the second time derivative.

The control devices of the railcars thus only need to calculate the time derivative of their own measurements which reduces power consumption.

In a further embodiment, messages sent over the slow network are divided into symbols, wherein each symbol is sent over a predetermined number of time frames, and are sent by pressure variances in the brake pipe, wherein a first symbol of the transmission is transmitted such that: during a first time frame, the pressure within the brake pipe is increased by a first predetermined amount; during a second frame, the pressure within the brake pipe is decreased by a second predetermined amount, wherein a second symbol of the transmission is sent such that: during a first time frame, the pressure within the brake pipe is decreased by a third predetermined amount; during a second frame, the pressure within the brake pipe (22) is increased by a fourth predetermined amount, wherein one of the first and second symbols represents a binary 0 and the other of the first and second symbols represents a binary 1.

This encoding into pressure value changes over time is easily distinguishable from normal operations on the brake pipe.

In a further embodiment, during a third time frame, the pressure within the brake pipe is returned to a basic pressure present in the brake pipe before the first time frame.

This constitutes a stop bit and allows a return of the pressure to a predetermined normal value.

In a further embodiment, the method may comprise determining whether a railcar not equipped with a control device is present in the train, wherein this may include comparing known lengths of the railcars to their relative distances to the locomotive and determining which of the relative distances between railcars and/or the locomotive are larger than the known lengths of the railcars in between.

Thus, railcars not equipped with control devices and/or communication devices may be accounted for.

The problem is further solved by a railcar comprising a control device, wherein the control device comprises a pressure sensor for detecting pressure changes within a brake pipe, wherein the control device is configured to decode an identification code of the locomotive encoded in the pressure changes, wherein the control device further comprises a communication unit for communicating over a wireless communications network and wherein the control device is configured to only respond to requests from a locomotive if an identification code sent with such a request corresponds to the identification code decoded from the pressure changes.

Railcars will thus only respond to locomotives that have the same unique identification code as the one received over the brake pipe. In this way, even when two or more trains stand side-by-side, each locomotive will only receive distance reports from railcars that are actually connected to it.

As shown in FIG. 1, a train 10 may comprise a locomotive 12 and a multitude of railcars 14, 16, 18, 20. The locomotive 12 and the railcars 14, 16, 18, 20 are connected to a brake pipe 22. The brake pipe 22 carries a pneumatic pressure from the locomotive 12 to the railcars 14, 16, 18, 20. Each of the railcars 14, 16, 18, 20 is provided with a braking unit that brakes the railcar 14, 16, 18, 20 when the pneumatic pressure in the brake pipe 22 is too low. Thus, should e.g. the brake pipe 22 be leaking, the braking units will stop the train.

The locomotive 12 comprises a control device 28 and the railcars 14, 16, 20 each comprise a control device 30, 32, 34. The railcar 18 does not comprise a control device. Each of the control devices 28, 30, 32, 34 may be different. In particular, the control device 28 of the locomotive 12 may be configured to output messages and receive commands from a human interface device 26 and may be configured to control a brake control unit 24.

The brake control unit 24 controls the pneumatic pressure inside the brake pipe 22. The control device 28 may control the brake control unit 24 based on user input received via the human interface device 26 and/or from other inputs, e.g. from sensors.

The locomotive 12 and each of the railcars 14, 16, 20 comprises a pressure sensor 36, 38, 40, 42 which senses the pneumatic pressure within the brake pipe 22 at the sensor's location. The brake control unit 24 may control the pneumatic pressure within the brake pipe 22 to transmit digital messages from the locomotive 12 to the railcars 14, 16, 20.

Each of the control devices 28, 30, 32, 34 comprises a communication unit 44, 46, 48, 50, each comprising an antenna. The communication units 44, 46, 48, 50 may connect to each other and/or send messages to each other via a wireless communications network 52.

Each of the control devices 28, 30, 32, 34 comprises a unique predetermined identification code which comprises a multitude of information bits and which may be used to identify each control device 28, 30, 32, 34 and/or may be used to address messages to one particular other control device 28, 30, 32, 34 and/or to determine the origin of messages received.

The control device 28 of the locomotive 12 may send its identification code to all the control devices 30, 32, 34 having a pressure sensor 38, 40, 42 on the brake pipe 22. To transmit the bits of its identification code, the control device 28 represents the bits as symbols encoded as sequences of pressure variations to be created in the brake pipe 22 by controlling the brake control unit 24. A message comprising the entire identification code of the control device 28 may be cyclically sent and resent via the brake pipe 22. By detecting the pressure variations and receiving the message, the control devices 30, 32, 34 can identify the control device 28 of the locomotive 12 that they are connected to.

As a pressure variation within the brake pipe 22 propagates through the brake pipe 22 at a comparatively slow speed, e.g. 280 m/s, the brake pipe 22 constitutes a slow network, whereas the wireless communications network 52 constitutes a fast network.

Furthermore, the control device 28 may broadcast its identification code and/or the brake pipe 22 pressure measured by its own pressure sensor 36 over the network 52. As the pressure variations within the brake pipe 22 travel at the speed of sound, each control device 30, 32, 34 may determine its distance from the locomotive 12 by measuring a time delay between the pressure variances detected by the pressure sensor 38, 40, 42 and the pressure variances as broadcast by the control device 28. The pressure variances as broadcast by the control device 28 act as a reference signal for the delay measurement.

In a further embodiment of the invention, the control device 28 may, for example, calculate a time derivative of the pressure measured by its own pressure sensor 36 and may broadcast the time derivative over the network 52.

In a further embodiment of the invention, the control devices 30, 32, 34 may determine a first time derivative of the pressure measured in the brake pipe 22 at their location and may determine a second time derivative of the pressure measured in the brake pipe 22 at the locomotive 12 from the pressure variances as broadcast by the control device 28. To determine the time delay between the pressure variances detected and the pressure variances as broadcast, the control devices 30, 32, 34 determine sign changes of the time derivatives. When corresponding sign changes of the time derivatives are detected within the first time derivative and the second time derivative, the time delay is determined as the time delay between the corresponding sign changes.

The control device 28 may send, via the network 52, a message requesting the time delay and/or a calculated distance from any one or all of the control devices 30, 32, 34. While it is possible that control devices not connected to this train may receive this message, only those control devices 30, 32, 34 which are connected to the same brake pipe 22 as the locomotive 12 have previously received the identification code of the control device 28. Thus, only those control devices 30, 32, 34 will respond to the message requesting the time delay and/or the calculated distance. In this way, locomotives 12 are able to determine which railcars 14, 16, 20 are connected to them.

From each time delay and the speed of sound within the brake pipe 22, a distance of each railcar 14, 16, 20 to the locomotive 12 may be calculated. This calculation may be carried out by the control device 28 of the locomotive 12 and/or by the control devices 30, 32, 34 of the railcars 14, 16, 20.

As the actual physical length of the locomotive 12 and the railcars 14, 16, 20 is known, the railcar 18, which does not have a control device, may be detected because the distance measured between railcar 16 and railcar 20 is too large.

Figure 2:
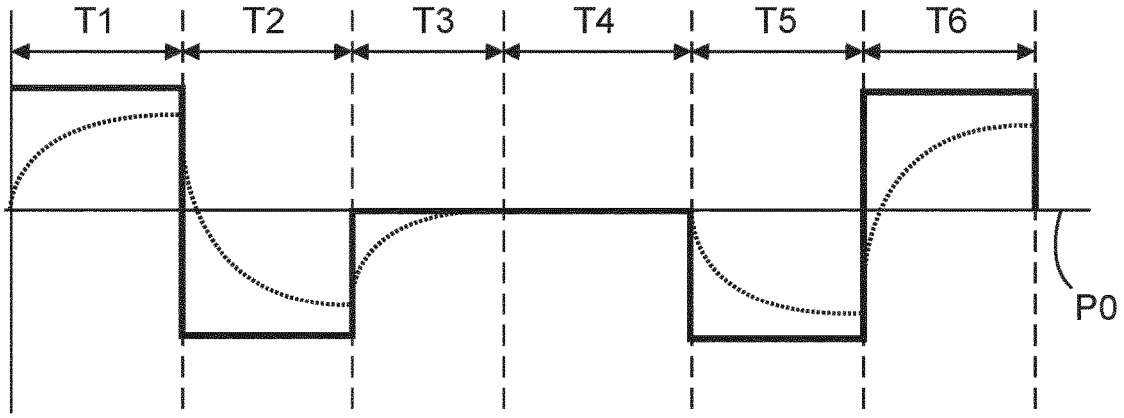

In further embodiments of the invention, to increase a reliability of transmitting the identification code of the control device 28 via the brake pipe 22, each bit may, for example, be represented by a symbol encoded as a sequence of pressure increases and/or decreases. FIG. 2 shows an example of such an encoding. The binary values of 0 and 1 are encoded as a sequence of deviations from a basic pressure P0. Each of the symbols extends over a multitude of timeframes T1, T2, T3, T4, T5, T6. The sequence displayed in FIG. 2 comprises a binary value of 0 encoded in timeframes T1 and T2 and a binary value of 1 encoded in timeframes T5 and T6.

In particular, the binary value of 0 is encoded by raising the pressure in the brake pipe 22 by a first predetermined amount as shown in timeframe T1, then lowering the pressure in the brake pipe 22 by a second predetermined amount during timeframe T2, then increasing the pressure in the brake pipe 22 to the basic pressure P0, which is also the pressure that was present in the brake pad 22 prior to the first timeframe T1, at the beginning of timeframe T3. In a similar way, the binary value of 1 is encoded by first lowering the pressure during timeframe T5 by a third predetermined amount, then increasing the pressure during timeframe T6 by a fourth predetermined amount and returning to the basic pressure P0 after timeframe T6 has elapsed.

In further embodiments of the invention, the binary values may be represented differently. For example, a symbol may comprise more than two timeframes during which different pressure variations may be used to encode the symbol. In a further example, a symbol may represent more than one binary digit. In a further example, multiple symbols may be used to represent the same binary value (e.g. 4B5B encoding).

In a further embodiment of the invention, the basic pressure P0 may be determined to be the pressure present in the brake pipe 22 at the locomotive 12 just before the beginning of timeframe T1.

In a further embodiment of the invention, the identification code may be unique over all the control devices created.

The present invention thus allows for secure identification of the cars connected to a train and will also work when some of the railcars 18 are not equipped with control devices.

LIST OF REFERENCES

10 train
12 locomotive
14 railcar
16 railcar
18 railcar
20 railcar
22 brake pipe (slow network)
24 brake control unit
26 human interface device
28 control device
30 control device
32 control device
34 control device
36 pressure sensor
38 pressure sensor
40 pressure sensor
42 pressure sensor

44 communication unit
46 communication unit
48 communication unit
50 communication unit
52 wireless communications network (fast network)
T1 time frame
T2 time frame
T3 time frame
T4 time frame
T5 time frame
T6 time frame

The invention claimed is:

1. A method for determining a sequence of railcars connected to a locomotive on a train, wherein a locomotive control device of the locomotive is connected to railcars on the train that each include a railcar control device via a brake pipe, wherein the control device of the locomotive and the rail car control devices are configured to exchange messages via a fast wireless network, the method comprising:

transmitting, by the locomotive control device of a unique identification code to the railcar control devices via a slow network constituted by the brake pipe;

transmitting, by the locomotive control device over the fast network, of messages indicative of a current state of the transmission carried out via the slow network, wherein the messages comprise the unique identification code;

determining by the control devices, of a time delay between the state of the transmission received from the control device and a state of the transmission measured on the slow network;

calculating a distance of each railcar to the locomotive from the time delay and a propagation velocity of the slow network;

requesting, by the locomotive control device of a report relating to the calculated distance and/or measured time delay by each railcar;

transmitting, by the railcar control devices, a report in response to the request, in response to an identification code in the request matching an identification code received via the slow network; and ordering the railcars by their distance to the locomotive.

2. The method of claim 1, wherein the transmitting via the slow network comprises creating pressure variances in a brake pipe to encode the identification code for transmission, wherein the state of the transmission is the pressure generated in the brake pipe at the locomotive by a brake control unit.

3. The method of claim 2, wherein the determination of the time delay comprises:

measuring, by a pressure sensor associated with the control device, of a pressure in the brake pipe at the railcar;

obtaining a first time derivative of the measured pressure in the brake pipe at the railcar;

obtaining a second time derivative of the measured pressure in the brake pipe at the locomotive; and determining the time delay as a time delay between corresponding sign changes of the first time derivative and the second time derivative.

4. The method of claim 3, further comprising:

measuring, by a pressure sensor associated with the locomotive control device, a pressure in the brake pipe at the locomotive;

calculating the second time derivative from the measured pressure;

sending the second time derivative to the control devices the second time derivative values over the fast network as messages indicative of a current state of the transmission carried out via the slow network;

wherein obtaining a second time derivative comprises receiving the messages comprising the second time derivative.

5. The method of claim 2, wherein the messages sent over the slow network are divided into symbols, wherein each symbol is sent over a predetermined number of time frames, and are sent by pressure variances in the brake pipe, wherein a first symbol of the transmission is transmitted such that:

during a first time frame, the pressure within the brake pipe is increased by a first predetermined amount;

during a second frame, the pressure within the brake pipe is decreased by a second predetermined amount, wherein a second symbol of the transmission is sent such that:

during a first time frame, the pressure within the brake pipe is decreased by a third predetermined amount; and during a second frame, the pressure within the brake pipe is increased by a fourth predetermined amount, wherein one of the first and second symbols represents a binary 0 and the other of the first and second symbols represents a binary 1.

6. The method of claim 5, wherein during a third time frame, the pressure within the brake pipe is returned to a basic pressure present in the brake pipe before the first time frame.

7. The method of claim 1, further comprising determining whether a railcar not equipped with a control device is present in the train by:

comparing known lengths of the railcars to their relative distances to the locomotive and determining which of the relative distances between railcars and/or the locomotive are larger than the known lengths of the railcars in between.

8. A control device comprising:

a pressure sensor configured to detect pressure changes within a brake pipe connected to a locomotive, wherein the control device is configured to decode an identification code of the locomotive encoded in the pressure changes; and a communication unit configured to communicate over a wireless communications network, wherein the control device is configured to only respond to requests from a locomotive in response to an identification code being sent with such a request corresponding to the identification code decoded from the pressure changes.

9. The control device of claim 8, wherein the transmission via the slow network includes creation of pressure variances in a brake pipe to encode the identification code for transmission, wherein the state of the transmission is the pressure generated in the brake pipe at the locomotive by a brake control unit.

10. The control device of claim 9, the determination of the time delay comprises:

measuring, by a pressure sensor associated with the control device, of a pressure in the brake pipe at the railcar;

obtaining a first time derivative of the measured pressure in the brake pipe at the railcar;

obtaining a second time derivative of the measured pressure in the brake pipe at the locomotive; and determining the time delay as a time delay between corresponding sign changes of the first time derivative and the second time derivative.

11. The control device of claim 10, wherein the control device is further configured to:

measure, by a pressure sensor associated with the locomotive control device, a pressure in the brake pipe at the locomotive;

calculating the second time derivative from the measured pressure; and sending the second time derivative to the control devices the second time derivative values over the fast network as messages indicative of a current state of the transmission carried out via the slow network, wherein obtaining a second time derivative comprises receiving the messages comprising the second time derivative.

12. The control device of claim 9, wherein the messages sent over the slow network are divided into symbols, wherein each symbol is sent over a predetermined number of time frames, and are sent by the pressure variances in the brake pipe, wherein a first symbol of the transmission is transmitted such that:

during a first time frame, the pressure within the brake pipe is increased by a first predetermined amount;

during a second frame, the pressure within the brake pipe is decreased by a second predetermined amount, wherein a second symbol of the transmission is sent such that:

during a first time frame, the pressure within the brake pipe is decreased by a third predetermined amount; and during a second frame, the pressure within the brake pipe is increased by a fourth predetermined amount, wherein one of the first and second symbols represents a binary 0 and the other of the first and second symbols represents a binary 1.

13. The control device of claim 12, wherein during a third time frame, the pressure within the brake pipe is returned to a basic pressure present in the brake pipe before the first time frame.

14. The control device of claim 8, wherein the control device is further configured to determining whether a railcar not equipped with a control device is present in the train by:

comparing known lengths of the railcars to their relative distances to the locomotive and determining which of the relative distances between railcars and/or the locomotive are larger than the known lengths of the railcars in between.

* * * * *